United States Patent [19]

Kim

[11] Patent Number: 5,022,214

[45] Date of Patent: Jun. 11, 1991

[54] PACKAGING MACHINE WITH BOX-FLAP FOLDING DEVICE

[75] Inventor: Man U. Kim, Suwon, Rep. of Korea

[73] Assignee: Samsung Electronics Co., Ltd., Suwon, Rep. of Korea

[21] Appl. No.: 601,044

[22] Filed: Oct. 22, 1990

Related U.S. Application Data

[63] Continuation of Ser. No. 262,591, Oct. 26, 1988, abandoned.

[51] Int. Cl.[5] ..... B65B 5/00; B65B 7/20; B31B 3/52

[52] U.S. Cl. ..... 53/242; 53/376.4; 493/183

[58] Field of Search ..... 53/242, 243, 374, 536, 53/541; 493/183, 453

[56] References Cited

U.S. PATENT DOCUMENTS

| | | | |
|---|---|---|---|
| 2,939,260 | 6/1960 | Ogle et al. | 53/242 |
| 3,605,377 | 9/1971 | Sable | 53/242 |
| 3,735,561 | 5/1973 | Wood | 53/245 |
| 3,842,571 | 10/1974 | Focke et al. | 53/186 |
| 4,062,168 | 12/1977 | Watts et al. | 53/245 |
| 4,275,543 | 6/1981 | Marchetti | 53/374 |
| 4,364,129 | 12/1982 | Luyett et al. | 53/374 |
| 4,524,560 | 6/1985 | Goodman | 53/374 |
| 4,548,593 | 10/1985 | Tisma | 493/56 |
| 4,569,182 | 2/1986 | Leuvering | 53/374 |
| 4,570,421 | 2/1986 | Focke | 53/491 |
| 4,611,458 | 9/1986 | Prakken | 53/247 |
| 4,674,261 | 6/1987 | Sabel | 53/242 |
| 4,805,383 | 2/1989 | Allwein | 53/528 |

FOREIGN PATENT DOCUMENTS

| | | |
|---|---|---|
| 0105104 | 4/1984 | European Pat. Off. . |
| 2573033 | 5/1986 | France . |
| 159457 | 12/1963 | U.S.S.R. . |
| 1438818 | 6/1976 | United Kingdom . |
| 2014533 | 8/1979 | United Kingdom . |
| 2049546 | 12/1980 | United Kingdom . |

*Primary Examiner*—William E. Terrell

*Attorney, Agent, or Firm*—Sterne, Kessler, Goldstein & Fox

[57] ABSTRACT

A box-flap folding device which includes a support for folded side flaps of the box during the folding operation of front and rear flaps. The support is so constructed as to prevent the folded side flaps from getting unfolded and not to interfere with the folding operation of the front and rear flaps, resulting in that all the flaps of the box can be folded smoothly without being bent or broken.

4 Claims, 5 Drawing Sheets

PACKAGING MACHINE WITH BOX-FLAP FOLDING DEVICE

This application is a continuation of application Ser. No. 07/262,591, filed 10/26/88, abandoned.

BACKGROUND OF THE INVENTION

1. Field of the Invention

The present invention relates to a box-flap folding device, and more particularly to an automatic box-flap folding device which includes means for supporting side flaps connected to the lower edges of the package box after being folded in order to prevent them from getting unfolded due to the reaction forces acting thereon.

2. Description of the Prior Art

In conventional box-flap folding devices used in box-packaging lines, side folders are firstly operated to fold the lower side flaps of the box and then the side folders are returned to their original positions during front and rear folders are operated to fold the lower front and rear flaps. At this moment, however, the side flaps once folded are apt to get unfolded due to the reaction forces acting on the side flaps.

Therefore, these conventional box-flap folding devices suffer from the disadvantages that the unfolding side falps collide with the front and rear flaps being folded and thus the flaps may not be folded smoothly but may be bent or broken.

SUMMARY OF THE INVENTION

It is an object of the present invention to provide an automatic box-flap folding device employing a supporting means which is advanced to support the central portions of the folded lower side flaps before the side folders are retracted after folding the side flaps so that the side flaps do not interfere with the folding operation of the front and rear flaps.

According to the present invention, there is provided an automatic box-flap folding device comprising conveyer means carrying the package box enclosing a product therein to a working position and taking it out to the next process after the folding operation, means for lifting the product to be entered into the box completely when the box is arrived at the working position by the conveyer means, control means limiting the lift of the lifting means and the box over the predetermined height, means for holding the product and the box after their positions are determined, side flap folding means for folding the lower side flaps of the box after the lifting means is returned to its original position, supporting means for preventing the folded side flaps from getting unfolded due to the reaction forces, and front and rear flap folding means for folding the lower front and rear flaps of the box.

BRIEF DESCRIPTION OF THE DRAWINGS

The present invention will now be described by way of illustrative example with reference to the accompanying drawings, in which.

DETAILED DESCRIPTION OF THE PREFERRED EMBODIMENT

Figure 1:
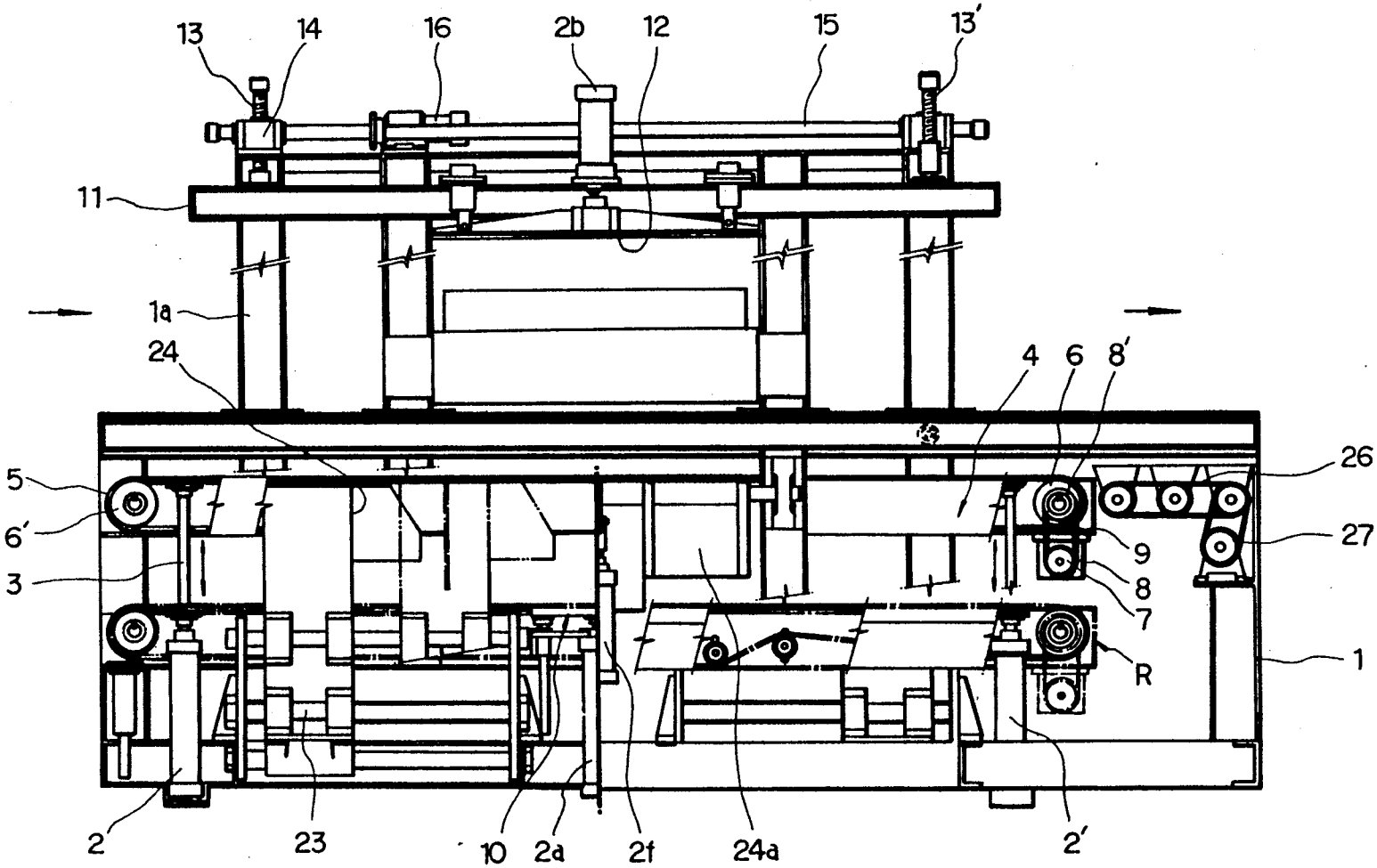
FIG. 1 is a front elevation of a box-flap folding device according to the present invention with some parts thereof omitted.

Referring to FIG. 1, the conveyer means including an elevator 4 attached to the upper ends of each rod 3 of cylinders 2 and 2' which are fixed to lower sides of a frame 1, a conveyer belt 5 driven by belt pulleys 6 and 6' fixed to each side of the elevator 4, a drive motor 7 for the rotation of the belt pulley 6, sprockets 8 and 8' and a chain 9 for the transmission of the driving force of the motor 7. The lifting means for lifting a product A, which is disposed to the central working position of the frame 1, includes a cylinder **2*a* attached to the elevator 4 and which rises and falls together with the elevator 4, and a push plate 10 attached to the upper end of the rod of the cylinder 2*a*. The control means for limiting the lift of a box B over a predetermined height includes a lifter 11 attached to an upper frame 1*a*, a cylinder 2*b* fixed to the center of the lifter 11 and a control plate 12 fixed to the lower end of the rod of the cylinder 2*b* and operated to rise and fall by the cylinder 2*a*. To the sides of the lifter 11 are attached the lower ends of rack shafts 13 and 13' which are rotatably engaged to a pinion shaft 15 within each housing 14. When a motor 16 is driven, the pinion shaft 15 and the rack shafts 13 and 13' are rotated simultaneously and the lifter 11 rises or falls according to the rotation direction of the rack shsfts 13 and 13'**.

Figure 2:
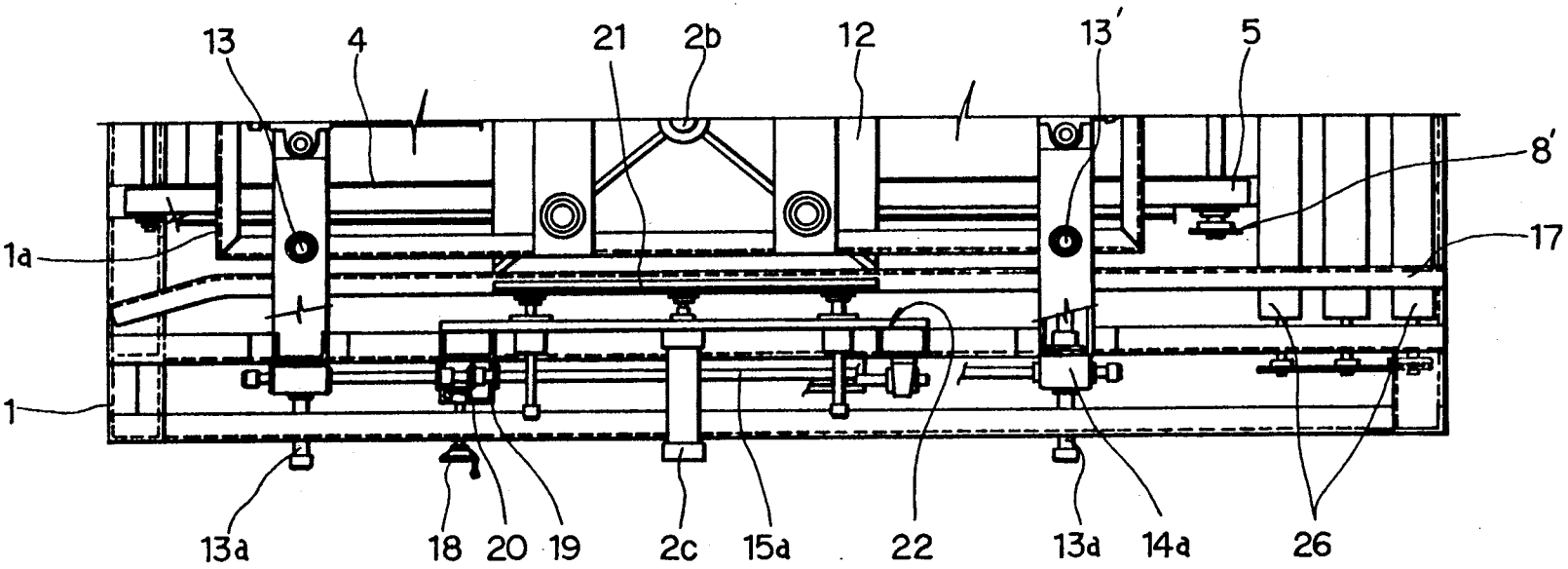
FIG. 2 is a top view of part of the device of FIG. 1.
Figure 3:
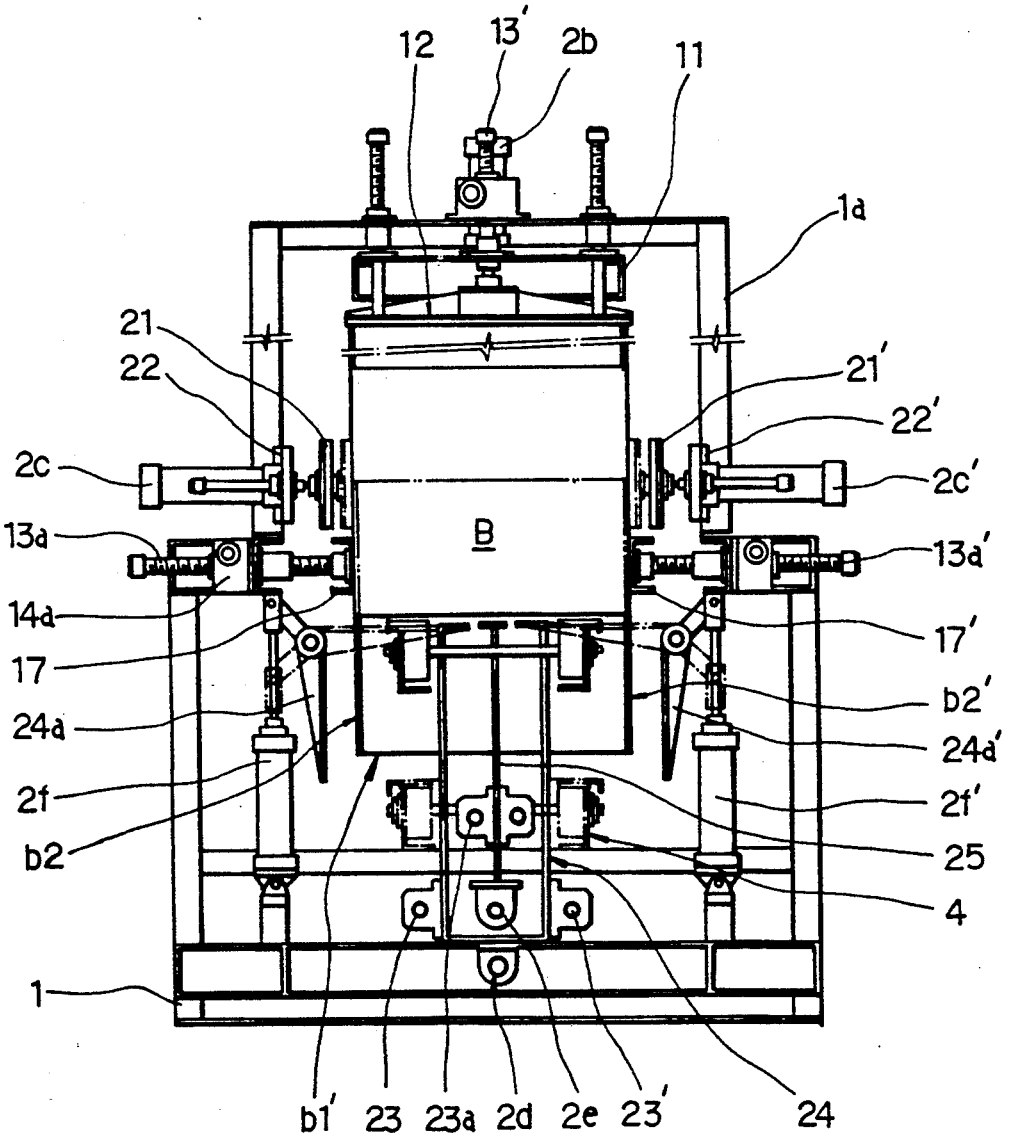
FIG. 3 is a side elevation of the device of FIG. 1 with some parts thereof omitted.

Referring now to FIG. 3, guides 17 and 17' for guiding the conveyance of the box B are provided to the upper front and rear surfaces of the frame 1. The outer sides of the guides 17 and 17' are attached to the inner ends of the rack shafts **13*a* and 13*a'* which are threaded through front and rear rack housings 14*a*. These rack shafts are engaged to the both sides of the pinion shaft 15 a within the rack housings 14*a*. The pinion shaft, as shown in FIG. 2, is rotated by means of the handle 18 via a bevel gear 20 in a gear box 19**.

Therefore, when the handle 18 is rotated, the bevel gear and the pinion shaft are rotated in turn and the rack shafts 13 and 13' are moved back and forth within the rack housing **14*a* according to the rotating direction. Consequently, the guides 17 and 17'** are simultaneously moved back and forth and thus the box can be transferred straightly as the moving distances of the guides are adjusted according to the length of the box B.

The holding means includes holders 21 and 21' to hold the box B and the product A therein at a predetermined position. The holders 21 and 21' are attached to the inner ends of the rods of the cylinders 2C and 2C' and moved back and forth by the cylinders, which are fixed to the upper frame **1*a* through the respective brackets 22 and 22' above the guides 17 and 17', i.e., at the front and rear sides under the upper frame 1*a***.

The folding means for folding the side flaps b1 and b1' includes a "[]" shaped folder 24 which is operated to move from right to left and vice versa along guide rods 23 and 23' by the cylinder 2d.

The supporting means includes a pair of "T" shaped supporters 25 which are moved from right to left and vice versa along each guide rod 23a by means of cylinders 2e and which are disposed at the middle of front and rear folding members 24b and 24b' of the side folders 24.

Further, the front and rear flap folding means includes swing folders 24a and 24a' which are operated to swing by means of cylinders 2f and 2f and which are attached to the upper ends of the rods of the cylinders 2f and 2f. An outgoing conveyer 26 disposed at the upper right side of the frame 1 is driven by a motor 27 and transfers the finished box B from the conveyer means to the next process.

Figure 4A:
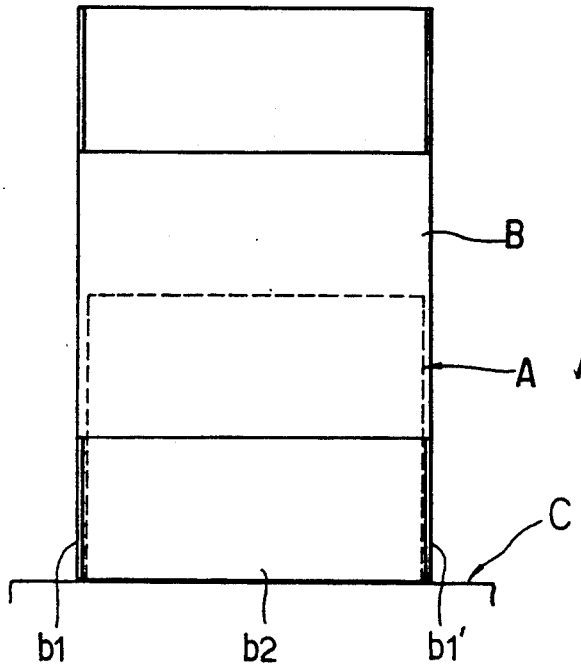
FIG. 4A is a front elevation showing the product and the box being conveyed.

The successive operations of the respective means according to the present invention is performed by a conventional automatic control system. When the box B which encloses the product A is transferred to the frame 1 by a seperate transfer conveyer C as shown in FIG. 4A, the conveyer means is positioned above the frame 1 as indicated by the solid lines in FIG. 1.

In this state, if the motor 7 is operated, the conveyor belt 5 is removed by the driving force of the motor being transmitted via a sprocket 8, a chain 9 and a sprocket 8'. Therefore, the conveyer belt 5 takes over the box B and the enclosed product A from the conveyer C and transfers them to the working position. Once they are arrived at the working position, the box B and the product A are stopped at the working position as the conveyer belt is stopped by the driving motor which is controlled by the automatic control system.

Figure 4B:
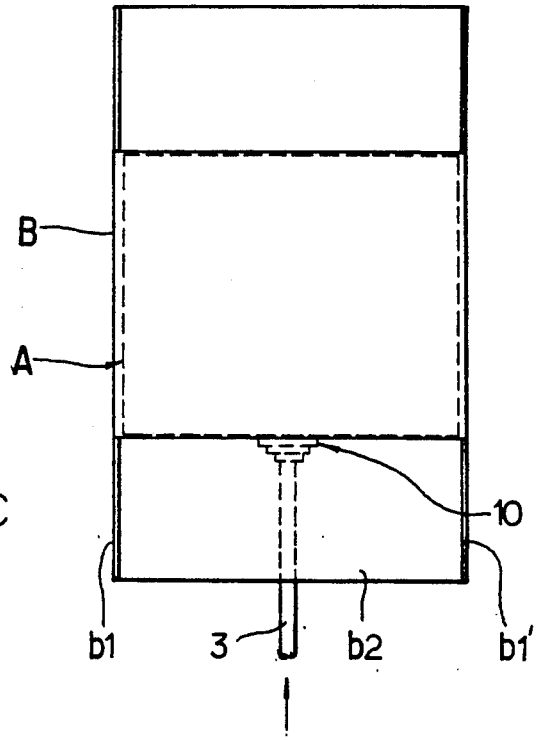
FIG. 4B is a front elevation showing the product being entered into the box by the device of FIG. 1.

Then, the cylinder 2a as a part of the means for lifting the product A is operated, lifts the push plate 10 and the product A is lifted to be entered into the box B by the push plate 10 as shown in FIG. 4B. Simultaneously, the cylinder 2b of the control means is also operated and lowers the control plate 12 which limits the concurrent rise of the box B during the lift of the product A by the push plate 10. Therefore, the entering of the product into the box B is ensured. The rising distance of the push plate 10 and the falling distance of the control plate 12 are present according to the size of the working object.

After the product A is entered into the box B completely, the cylinders 2C and 2C' of the holding means are operated to advance the holders 21 and 21' to firmly hold the box B together with the inside product A. Then as the cylinder 2aof the lifting means and the cylinder 2b of the control means are operated reversely, the push plate 10 and the control plate 12 are returned to their original positions respectively. Also, as the cylinders 2 and 2' of the conveyer means are operated reversely and their rods 3 are lowered, the elevator 4 is lowered to the position indicated by the phantom line R in FIG. 1.

Figure 4C:
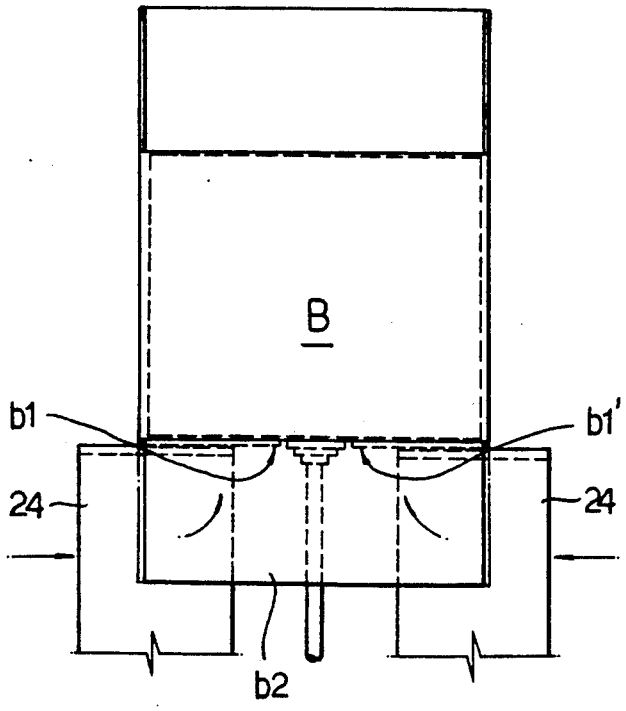
FIG. 4C is a front elevation showing the lower side flaps of the box being folded by the device of FIG. 1.
Figure 5A:
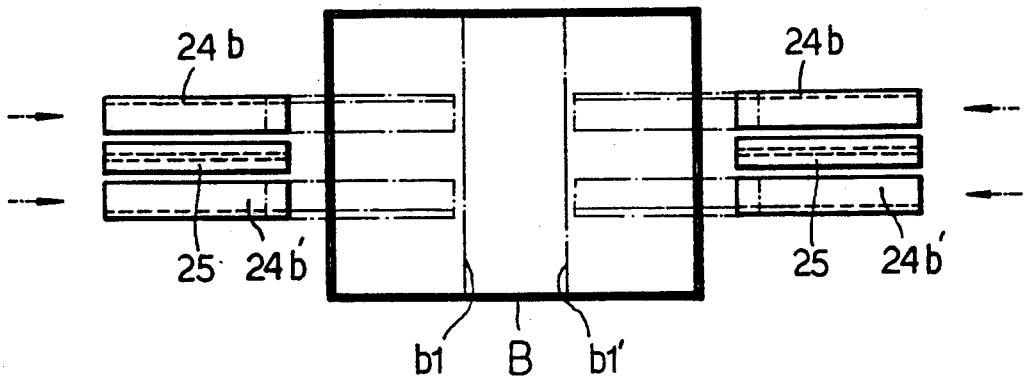
FIG. 5A is a top view showing the lower side flaps of the box being folded by the device of FIG. 1.
Figure 5B:
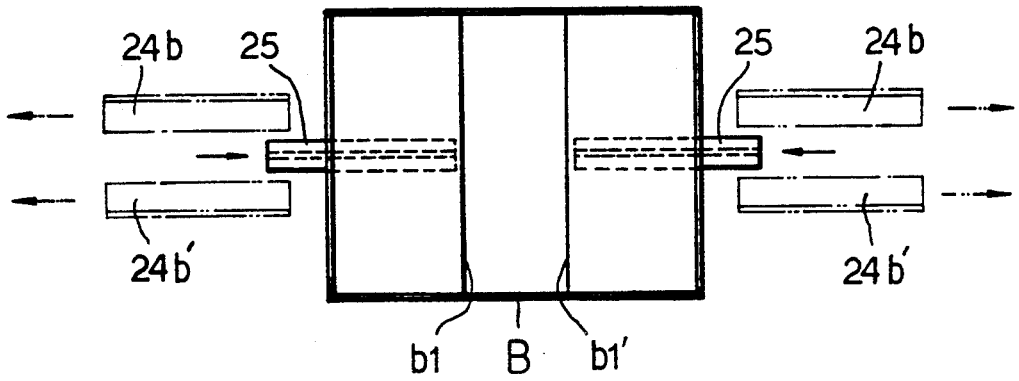
FIG. 5B is a top view showing the side flaps supported by the supporting means according to the invention.

Accordingly, the box B and the enclosed product A are firmly held and hung by the holding means. Then, as the cylinder 2d of the means for folding the lower side flaps b1 and b1' of the box B is operated, the side folders 24 are advanced concurrently and fold the flaps b1 and b1' as shown in FIGS. 4C and 5A. Thereafter, the cylinder 2e of the supporting means is operated and the supporters 25 at both sides support the middle portions of the folded flaps b1 and b1' as shown in FIG. 5B. Simultaneously, the cylinder 2d is operated reversely to retract the folders 24 to their original positions.

As the flaps b1 and b1' are folded by means of the front and rear "[]" shaped folders 24, thses flaps can be folded smoothly. Also, the folders 24 are retracted after the flaps b1 and b1' are folded and thus they do not interfere with the folding operation of the front and rear flaps b2 and b2'. Further, the supporters 25 support the folded flaps b1 and b1' in order to prevent the folded flaps b1 and b1' from getting unfolded due to the reaction force and from interfering with the folding operation of the front and rear flaps b2 and b2'.

Figure 6:
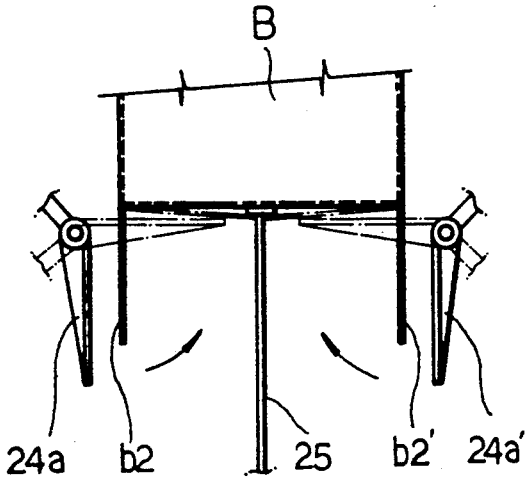
FIG. 6 is a side elevation showing the front and rear flaps being folded by the device of FIG. 1.

After the side flaps b1 and b1' are folded by the above-described operation, the front and rear flaps b2 and b2' are then folded by means of the cylinders 2f and 2f of the folding means, which are operated to rotate the swing folders 24a and 24a' as indicated by the phantom lines r in FIG. 6. The supporter 25 does not interfere with the folding operation of the front and rear flaps b2 and b2' as it is in the middle position.

After the side flaps as well as the front and rear flaps are folded completely, the side folders 24 are advanced again and support the folded flaps, while the supporters 25 and the folders 24a and 24a' are returned to their original positions. Then, the elevator 4 is lifted to its original position as the cylinders 2 and 2' are operated to lift the rods 3. Thereafter, the cylinder 2a is operated to lift the push plate 10 so as to contact with the bottom of the box B covered by the folded flaps. Simultaneously, the cylinder 2f of the side folders 24 and the cylinders 2C and 2C' of the holding means are operated reversely to their respective original positions making the box B placed on the push plate 10. In this state, if the push plate 10 is lowered to its original position by the reverse operation of the cylinder 2a, the box is placed on the conveyer belt 5. Thereafter, the conveyer belt 5 is operated by the driving motor 7 again and the finished box B which encloses the product A is transferred to the next process by the outgoing conveyer 26 driven by the motor 27.

As described above, it will be apparent that the present invention provides advantages to prevent the folded side flaps from getting unfolded by means of the supporting means and thus not to interfere with the folding operation of the front and rear flaps, resulting in that the box-flaps can be folded smoothly without being bent or broken.

What is claimed is:

1. A box flap folding device, comprising:

means for vertically lifting a product to be entered into a box straight up into the box to a pre-determined height;

control means to limit the vertical travel of the box during the lifting up of a product into the box;

holding means to provide opposing later forces to opposite sides of the box for supporting the box and the product therein after the product has been lifted into the box to the predetermined height;

side flap folding means for folding lower side flaps of said box;

front and rear flap folding means for folding lower front and rear flaps of said box; and means for supporting the side flaps folded by said side flap folding means;

wherein said supporting means is so contructed as to prevent the folded side flaps from becoming unfolded during the operation of said front and rear flap folding means.

2. A box-flap folding device as claimed in claim 1, wherein said supporting means includes a pair of "T" shaped supporters, a pair of cylinders respectively moving said T shaped supporters from right to left and vice versa and a pair of guide rods guiding said linearly T shaped supporters respectively.

3. A box-flap folding device as claimed in claim 1 or 2, wherein said supporting means is disposed in the middle of said lower side flaps during operation of said front and rear flap folding means.

4. A box-flap folding device as claimed in claim 3, further comprising:

guide means for laterally guiding the conveyance of each box as it is passed through the box-flap folding device, and adjustment means for adjusting said guide means so that said guide means may accommodate boxes of varying size.

* * * * *

UNITED STATES PATENT AND TRADEMARK OFFICE

CERTIFICATE OF CORRECTION

PATENT NO. : 5,022,214

DATED : June 11, 1991

INVENTOR(S) : Man UHP Kim

It is certified that error appears in the above-identified patent and that said Letters Patent is hereby corrected as shown below:

Col. 4, Claim 1, line 55, "later" should read --Lateral--;

Col. 5, Claim 2, line 4, "supporters from" should read --supporters linearly from--; and Col. 5, Claim 2, line 5, "said linearly T" should read --said T--.

Signed and Sealed this

Twenty-ninth Day of December, 1992

*Attest:*

DOUGLAS B. COMER

*Attesting Officer*

*Acting Commissioner of Patents and Trademarks*